United States Patent [19]

Williams

[11] Patent Number: 4,680,907

[45] Date of Patent: Jul. 21, 1987

[54] CONSTRUCTION MATERIAL

[76] Inventor: Richard D. Williams, 9725 NE. Shaver St., Portland, Oreg. 97220

[21] Appl. No.: 791,999

[22] Filed: Oct. 28, 1985

[51] Int. Cl.[4] ..... E04C 1/40

[52] U.S. Cl. ..... 52/309.17; 4/614; 52/445; 428/150; 428/331; 428/414; 428/446; 428/537.1

[58] Field of Search ..... 428/414, 150, 331, 537.1, 428/446; 4/596, 612, 614; 52/309.17, 445, DIG. 7

[56] References Cited

U.S. PATENT DOCUMENTS

| | | | |
|---|---|---|---|
| 926,773 | 7/1909 | Schirra | 52/413 |
| 1,322,278 | 11/1919 | Armstrong | 428/150 |
| 1,486,535 | 3/1924 | Munroe | 52/411 |
| 2,060,084 | 11/1936 | Johnston | 428/537.1 |
| 2,253,298. | 8/1941 | Hyde | 428/150 |
| 3,502,539 | 7/1966 | MacPhail, Sr. | 428/143 |
| 3,649,424 | 3/1972 | Rhiando | 52/315 |

*Primary Examiner*—George F. Lesmes
*Assistant Examiner*—P. R. Schwartz
*Attorney, Agent, or Firm*—Robert L. Harrington

[57] ABSTRACT

A building material for cement based facing such as stucco and brick facing. A thin layer of water impervious epoxy is applied to one side of a wallboard or plywood sheeting. Sand is imbedded in the epoxy in a manner to fully cover the epoxy. The sand surface provides a compatible bonding surface for stucco and mortar which are then applied in a conventional manner.

7 Claims, 3 Drawing Figures

CONSTRUCTION MATERIAL

FIELD OF INVENTION

This invention relates to a composite including a substrate material, e.g. wallboard, having bonded thereto a cement based facing, e.g. stucco or brick facing.

BACKGROUND OF THE INVENTION

Buildings contemplated for the present invention have a brick or stucco facing applied over wallboard or plywood sheeting. Such sheeting has structural integrity and contributes to the framework of a building. It is sometimes referred to hereafter as the structural substrate. Wood based materials are damaged by moisture, and cement based materials are pervious to moisture. Thus a moisture barrier must be sandwiched between the substrate and stucco to prevent moisture damage to the substrate. However, the moisture barrier presents the problem of achieving adequate bonding of the stucco to the substrate through the moisture barrier. A composite for such a construction material, prior to this invention, included:

(a) The substrate nailed to the frame;

(b) A moisture barrier, e.g. tarpaper tacked to the substrate;

(c) A metal mesh nailed to the substrate through the tarpaper;

(d) An undercoating of stucco physically bonded to the mesh and;

(e) The application of the finished coating of stucco to the undercoating.

This process includes a multiple of steps and materials that makes the building process expensive and therefore objectionable. Whereas the mesh is fastened to the substrate with nails (i.e. the fasteners are spaced apart), it is important that the composite of the screen and stucco have substantial integrity independent of the substrate. To accomplish the desired integrity, the stucco material is required to be fairly thick. It is accordingly an object of the present invention to reduce the steps and the materials used in the process to thereby provide a fully competitive stucco facing at a substantially reduced cost of production.

SUMMARY OF INVENTION

This invention includes the provision of a composite that achieves the desired bonding of stucco to a wood based substrate but which is also impervious to moisture. It replaces the tarpaper, screen and stucco underlayer and substantially reduces the required thickness of stucco. Briefly, it comprises a thermal bonding plastic, i.e., epoxy that partially penetrates the surface of the wood substrate and creates a secure bonding to the wood substrate that seals the surface against moisture penetration. Sand is embedded but not immersed in the plastic in such a way that the entire exposed surface is the raw sand surface, i.e., sand that is not coated with the epoxy material. The rough sand exterior is chemically and physically compatible with the stucco and a secure bonding is achieved by the application of the stucco directly onto the sand exterior. The sand and epoxy interlayer is uniformly fully surface bonded to the substrate and thereby transmits the strength of the wood substrate to the stucco. Thus a much thinner coating of the stucco can be applied.

The invention will be more clearly understood by reference to the following detailed description and drawings wherein.

Figure 1:
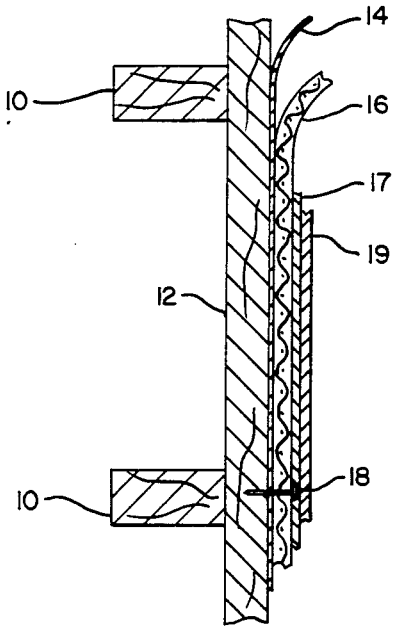
FIG. 1 Prior Art
FIG. 1 illustrates the construction of a stucco faced substrate prior to the present invention.

FIG. 1 of the drawings illustrates a typical stucco faced construction prior to the invention. Stud 10 represents the framework of a building to which is fastened a sheet of base material such as plywood 12 or the like. Because the plywood will be damaged by moisture, a moisture barrier in the form of tarpaper 14 is fastened to the face of the plywood 12.

Cement materials will not adequately adhere to the surface of the tarpaper 14 and thus a metal screen 16 is physically attached, i.e., with fasteners such as nails 18 that penetrate through the tarpaper and into the plywood 12. The metal screen is designed to provide a maze of exposed edges that function as gripping fingers. An undercoating 17 of stucco is imbedded into the screen and upon drying, is mechanically secured to the screen. The undercoating is provided to be chemically compatible with the desired stucco overcoat and thus the overcoat 19 is applied to achieve the desired secure attachment to the undercoating through chemical bonding. The undercoating is mechanically bonded to the screen, and the screen is fastened with fasteners to the plywood (with the moisture barrier sandwiched therebetween).

Figure 2:
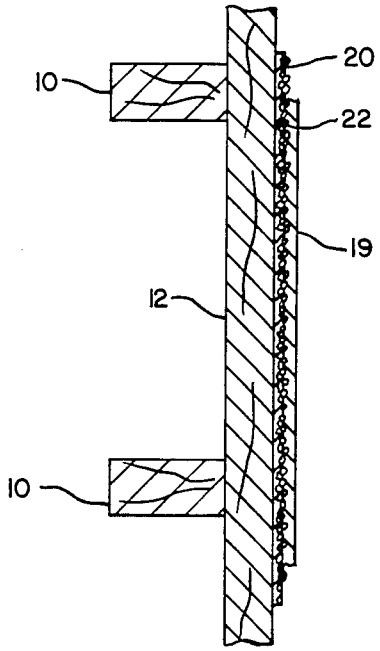
FIG. 2 illustrates the construction of a stucco faced substrate in accordance with the present invention.

FIG. 2 illustrates the structure of the invention. As in the construction of FIG. 1, a plywood sheet 12 is fastened to a frame 10. A plastic two part thermal bonding epoxy 20 is then coated over the plywood, and while still soft, sand 22 is coated over the epoxy. The sand 22 is applied in sufficient quantity to completely cover the exposed surface area of the epoxy. Whereas the sand is embedded to a sufficient depth to achieve secure bonding, the application is done in a manner to expose only the untreated or raw sand, e.g., the thin layer 20 of the epoxy may be held to a thickness that is less than the screen size of the sand. Note that the succeeding layer of stucco will not bond to the epoxy and its exposure through the sand layer should be avoided.

It will be appreciated that the same property of the wood based material that requires the avoidance of moisture, i.e., it is porus, lends itself to a very secure bond with the epoxy. The epoxy partially penetrates into the substrate and, upon drying, becomes firmly interlocked with the substrate. Furthermore, the epoxy is itself water impervious and thus even a thin coating securely seals the wood surface and very effectively functions as a water barrier.

The sand offers a rough surface and is chemically compatible with the cement based stucco material 19 (as long as the sand is not itself coated with the epoxy). Thus the stucco 19 can now be simply applied to the sand surface by conventional techniques and the result is a strong bond that at least equals the prior art methods of bonding, but at a substantially reduced cost.

Figure 3:
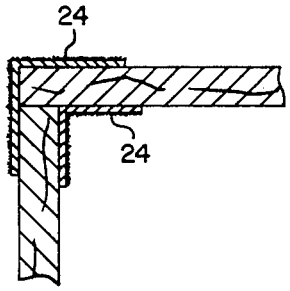
FIG. 3 illustrates corner sections used for sealing the joints between substrate sections.

Reference is now made to FIG. 3 illustrating the means by which the joints between two substrate sections are protected. The illustration of FIG. 3 is of corner strips 24 but the reader will appreciate that flat strips may be provided for substrate sections that are abutted end to end. These strips 24 are preferably plastic with sand embedded in the outside surface. Thus after the substrate sections are mounted to the wall, the strips 24 are applied to cover the joint. The stucco is then applied over the entire assembly to produce a continuous wall appearance that is fully sealed against moisture. The strips offer the added advantage of accomodating some misfit of the abutting substrate sections. Also, with sand exposed on both sides of the strips, a thin set mortar can be used to apply the strips to the substrate, and in the case of the strips 24, the same strip can be used for either the inside or outside corner.

Specific Example

In a specific example of the invention, a ⅜ inch plywood sheet was used as the substrate. An epoxy, identified as EAS-8 epoxy from the QCM Co., was prepared and applied as a thin layer (approximately 6 mils thick) to one side (the outer side) of the plywood sheet. This epoxy is a two part epoxy polysulfide rubber adhesive. (One means used to control thickness was to lay a thin (1/16 in.) mesh cheese cloth on the substrate and fill the voids of the cheese cloth with the epoxy to the thickness (12 mils) of the cheese cloth.)

While the epoxy was still soft, i.e., within the first couple of minutes after mixing, a liberal quantity of sand sized to 30 lapis was poured over the surface of the epoxy. The plywood sheet was laid flat and the sand was applied so as to insure a complete covering of the epoxy layer. The sand was allowed to set into the epoxy and after the epoxy was cured (e.g. within 10 minutes of application) the sheet was turned upside down to remove the loose sand.

The prefabricated sheet was then placed against a structural frame and nailed into place with self sealing nails. Strips 24 were applied over the joints between substrate sections. Thereafter a coating of stucco was applied in the same manner as finished stucco coating is applied in conventional techniques but to a substantially reduced thickness. When the stucco coating was fully cured, the bonding was tested and found to exceed the bonding strength of prior conventional structures.

In further examples of the invention, prefabricated plywood sheeting was prepared and nailed to a frame. In one such further example a layer of thin brick was applied by conventional methods, e.g., with a coating of thin set mortar that bonded to the sand surface. Brick and mortar joints were then successfully applied to the mortar. In a still further example, ceramic tile was applied in much the same way as the thin brick, i.e., a layer of thin set mortar was applied to the sand surface and then the tile and mortar joints were applied to the thin set mortar layer.

Variations

The primary advantage of the invention is to provide decorative stucco and brick facings to the outside of buildings, i.e., it provides secure bonding of the facing and a watertight seal by an efficient and inexpensive process. However, a very beneficial indoor application of the invention is for the walls and floors of shower stalls and other areas where the walls and floors are subjected to moisture. Shower basins in particular are noted for breaking down over time and causing leakage and water damage to the substrate. This problem is greatly alleviated by the utilization of the present process.

Those familiar with the art will conceive of variations to the embodiments shown herein but without departing from the invention as defined in the accompanying claims.

I claim:

1. A construction material comprising; a wood based moisture damageable structural substrate adapted to be fastened to a building as part of the building frame, a water impervious epoxy thinly layered directly over one surface of the substrate and firmly bonded thereto, a sand overlayer partially embedded into the epoxy layer to substantially cover the epoxy surface and present an epoxy free sand surface as the exposed securing surface, and a cement based decorative facing material adhered to the sand surface.

2. A construction material as defined in claim 1 wherein the epoxy layer is less thick than the screen size of the sand whereby emersion of the sand in the epoxy layer insures an epoxy free portion of the sand protruded out of the epoxy layer.

3. A construction material as defined in claim 1 wherein the epoxy material is a two part thermal epoxy that is soft upon mixing of the two parts to permit application and embedding of the sand, and hardens upon setting into a strong mechanically and chemically bonded surface coating.

4. A construction material as defined in claim 1 wherein the decorative material is a cement based stucco applied over the exposed sand surface.

5. A construction material as defined in claim 1 wherein thin set mortar is coated over the sand and a brick facing is adhered to the mortar.

6. A construction for shower stalls comprising; a frame, a moisture damageable wood based structural substrate fastened to the frame and forming part of the frame, water impervious epoxy applied directly to the inside surface of the substrate, and sand embedded in the epoxy in sufficient quantity to expose only an epoxy free sand surface, and mortar coated over the sand surface and ceramic tile embedded in the mortar.

7. A construction material comprising; a wood based moisture damageable structural substrate fastened to a building as part of the building frame, a water impervious epoxy thinly layered directly over one surface of the substrate and firmly bonded thereto, a sand overlayer partially embedded into the epoxy layer to substantially provide an epoxy free sand coating over the epoxy layer, and a cement based decorative facing material adhered to the sand coating.

* * * * *